US008413568B2

(12) United States Patent
Kosheleff

(10) Patent No.: US 8,413,568 B2
(45) Date of Patent: Apr. 9, 2013

(54) MINE PROTECTION FOR VEHICLE

(76) Inventor: Patrick Andrew Kosheleff, Yankee Hill, CA (US)

( * ) Notice: Subject to any disclaimer, the term of this patent is extended or adjusted under 35 U.S.C. 154(b) by 0 days.

(21) Appl. No.: 13/135,805

(22) Filed: Jul. 15, 2011

(65) Prior Publication Data

US 2013/0014635 A1 Jan. 17, 2013

(51) Int. Cl.
*F41H 7/02* (2006.01)

(52) U.S. Cl. ..... 89/36.08; 89/36.05; 89/36.07

(58) Field of Classification Search ..... 89/36.08, 89/40.01, 40.03, 36.05
See application file for complete search history.

(56) References Cited

U.S. PATENT DOCUMENTS 3,765,299 A * 10/1973 Pagano et al. ..... 89/36.08
5,533,781 A * 7/1996 Williams ..... 296/204
2007/0084337 A1* 4/2007 Strassgurtl et al. ..... 89/36.08

* cited by examiner

*Primary Examiner* — Stephen M Johnson
*Assistant Examiner* — John D Cooper

(57) ABSTRACT

A utility vehicle with underfloor structure giving protection from mine explosions. There is a wedge at the edge of the driver compartment which splits the detonation blast from a mine buried in the track of a front wheel. There is a multilayer stack, inboard of the wedge, which crushes upward to reduce the detonation wave from a mine buried under the vehicle. The stack comprises panels to catch the detonation wave and separated by spacers. Spacers are longitudinal stringers stacked above each other and welded, forming deep beams joined to bulkheads, making the vehicle's frame. The wedge also bolts to bulkheads, augmenting the frame. In cross section, the stack is curved, tapering off at each end to merge with the "V" of a wedge. The wedge crushes sideways under the detonation wave, providing protection at the edge of the driver compartment where stack material has run out.

2 Claims, 4 Drawing Sheets

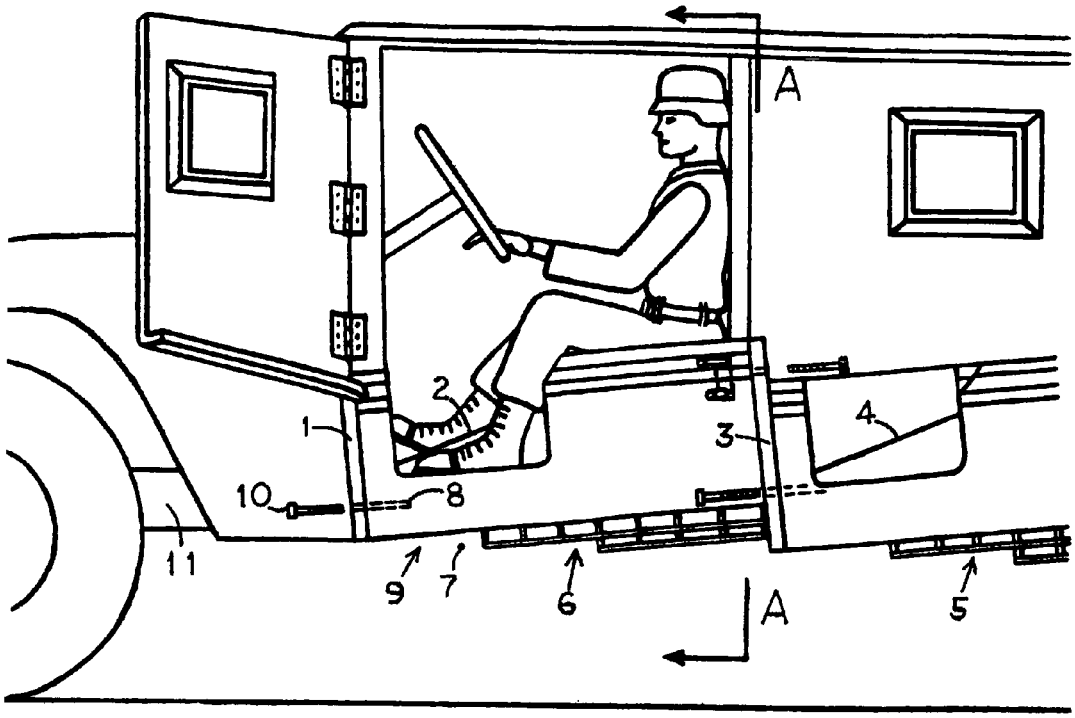
FIG. 1
FIG. 2
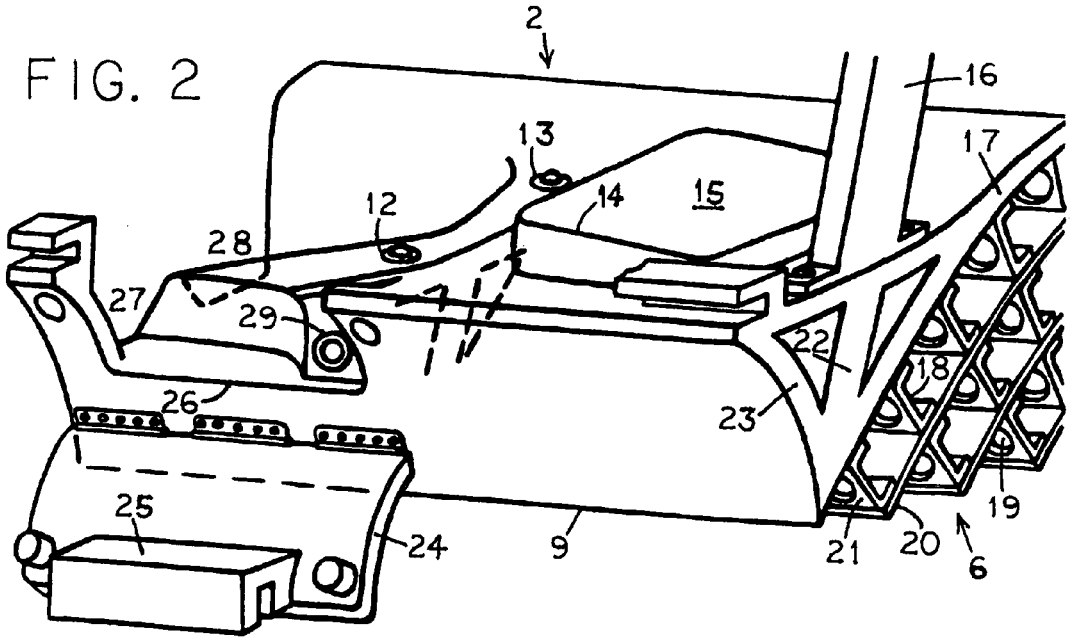

A - A

MINE PROTECTION FOR VEHICLE

BACKGROUND OF THE INVENTION

Ours is a military vehicle with crushable structure under the floor, and a blast-deflection wedge at the side of the passenger compartment. To protect the occupants from mine explosions under and beside the vehicle.

U.S. Pat. No. 7,255,034 shows a "mine-detonation-resistant understructure for a vehicle." The information of interest is about previous armoring, found in column 4: "Usually, the armoring against land mine blasts are multilayer structures." We have a related construction. His criticism is, "which require a massive support arrangement which is both heavy and expensive." We circumvent this problem by making the spacers of the multilayer, the frame of our vehicle. That replaces the weight and expense of a conventional frame.

U.S. Pat. No. 6,658,984 in his background text similarly cites, "superposed plates and hollow layers, such as air layers." This again suggests the layered structure in ours. In addition, he writes, "damping elements to reduce and absorb the mine effect are provided in an intermediate floor." Our crushable spacers between the several plates seem to be an example of that too. There is no mention of combining the multilayer with a wedge at the edge of the vehicle.

U.S. Pat. No. 5,533,781 shows a Humvee-style vehicle with "panel, air gap, resilient material and flooring" at the bottom of the passenger compartment. Panels and air gaps actually describe our crushable structure better than the more generic "layers" used in the two prior references; but our arrangement is different.

U.S. Pat. No. 2,382,862 in its FIG. 2 has a wedge-shaped fold 25, 36 in body sheet metal at the edge of the passenger compartment. This being somewhat less than armor plate, and not reinforced, it might collapse under a mine explosion of any likely size.

The strength of our crushable structure makes it usable as the vehicle frame. Spacers are vertically aligned with other spacers, thereby combining their webs to form a deep beam for the frame. Panels to catch the detonation wave are interleaved with the stringers. The panels act as flanges to the beam web, thereby stiffening the beam for use in the frame. No prior example was found.

SUMMARY OF THE INVENTION

A motorized land vehicle capable of military transport duty and provided with mine-protection structure below the floor of the passenger compartment. Considering the driver's seating area only, the protective structure includes a wedge and a stack. They run lengthwise of the driver's compartment. The wedge's job is to split the detonation blast of a mine buried in the track of the vehicle's left front wheel. The stack's job is to crush controllably under the detonation wave of a mine buried below the vehicle.

The transverse cross section of the wedge resembles a "V". One arm of the "V" faces outside the driver's compartment, and the other arm extends upward and inward toward the centerline of the vehicle. The point of the "V" heads down steeply toward the ground. In operation, the wedge divides the blast rising upward from a mine buried more or less under the outside edge of the vehicle. Half of the blast escapes into thin air outside the driver's door. The other half of the blast passes under the wedge and heads inward. It encounters the stack and flows through openings in the stack for an instant, before the stack is blown away.

The stack is a multilayer of panels separated by spacers which create air layers between the panels. The panels catch the detonation wave of a mine buried under the vehicle and are slammed upward toward the floor of the driver compartment. The spacers oppose this motion and collapse, absorbing energy from the detonation.

These actions decrease the breaking force of the explosions and protect the driver to an extent.

The second part of the invention is to make double use of the protective structure and have it constitute the frame of the vehicle, in order to save weight. To that end, three spacers considered as longitudinal stringers are stacked vertically so that their webs add up to a deep beam of some strength. Two deep beams, spaced apart, constitute special frame means which replace a conventional frame. The wedge can be bolted to bulkheads front and rear of the driver compartment, augmenting the frame strength.

The cross section of the stack is deepest near the centerline of the vehicle, tapering off to shallower structure at its side where the stack merges with the wedge. The contour of the inside arm of the wedge is congruent to the shallow extremity of the stack. Thus, the wedge's material increases as the stack's material thins out at the edge of the stack. The wedge is configured to crush sideways under the detonation wave, absorbing more energy. Therefore, the wedge can perform an alternative protective function, which is an economy.

BRIEF DESCRIPTION OF THE VIEWS

FIG. 1 is a side elevation of the vehicle.

FIG. 2 is a ¾ overhead rear view of the driver seating platform.

DETAILED DESCRIPTION

Figure 3:
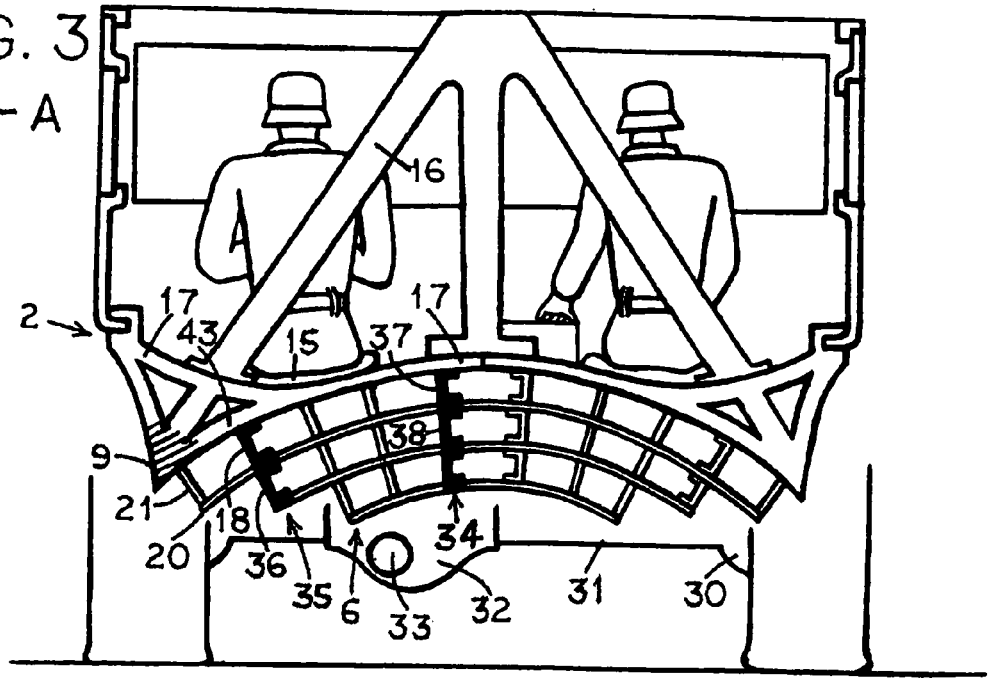
FIG. 3 is a transverse cross section of the vehicle from FIG. 1.

FIG. 1 is a side view of a military utility vehicle patterned after the U.S. Army's "Humvee". Modifications are made below the passengers to protect them from mine explosions. This document will only look at driver protection. The mines are buried below or beside the vehicle, and sample explosion and damage scenarios will be shown in later figures. For now, the new equipment is designated as a stack 6 and a wedge 9. The driver sits in sculpted platform 2 which is somewhat like a bathtub, in that it encloses the driver from below. Wedge 9 is mainly intended to protect the driver from a mine explosion at the edge of the vehicle. Stack 6 will protect from a mine explosion under the vehicle. Platform 2 construction is examined first.

FIG. 2 shows platform 2 slightly from above and the rear. Line 14 of seat cushion 15 will be horizontal, so platform 2 is actually at a downward slant like in FIG. 1. The main parts which deal with driver seating are back brace 16, seat cushion 15 and footwells 27 and 28 (numbers without leaders or underlines refer to the volumes in which they are located.) Platform 2 is the bottom of the driver compartment. There is a floor 17 which extends left and right all the way across. At the front (left side of the drawing) the floor contour will end up more complicated, as shown, because of the footwells. Platform 2 was first fabricated as a single, large extrusion in aluminum whose cross section is seen at the end of the leaders for numbers 17, 22 and 23. Brace 22 is ignored for now. The important component is wedge 9 which will split some blast gas. Wedge 9's cross section is shaped like a "V". The "V"'s short arm 23 faces outward, and the long arm reaches halfway across the driver compartment to floor 17.

The difference between footwells 27, 28 and floor 17 shows the post-extrusion fabrication operations. There is a deep draw with heating at the northwest corner of platform 2 which creates footwell 28. The metal came from floor 17. At the southwest corner of platform 2, a milling cutter (not shown) carved away the end of wedge brace 22, leaving footwell 27. The footwells initiate a comfortable downward angle for the driver's legs (seen in FIG. 1.) Swinging the feet out of platform 2 when exiting the vehicle is made possible by opening 26 in FIG. 2. Cover 24 dropped open on its hinges, exposing opening 26 and footstep 25. Cover 24 would be pulled up to fit flush over opening 26 when the driver's door (not shown) closed. Linkage to the driver's door for actuating cover 24 is not included in FIG. 2 but can be imagined as a few pivots and links. Wedge 9 of platform 2 will be put to work as a protective device in FIGS. 5 and 6, but for now platform 2 is just where the driver sits. Stack 6 is composed of panels 20 and spacers 21, which for visibility are drawn thicker than they would be in practice, except spacer 18 which will become a structural member. To be re-visited later.

FIG. 3 is a cross section of the passenger compartment taken at viewing plane A-A of FIG. 1. In FIG. 3, the driver seen from the rear sits on cushion 15 located on driver compartment floor 17. The driver's back may rest on brace 16, or some other back rest not shown. At the front of this four wheel drive vehicle are seen the front axle 31 with differential 32, front driveshaft 33 and C-V joint 30 for steering the right front wheel.

Stack 6 is seen in cross section. The primary purpose of stack 6 is protection from mines. This paragraph looks at the structure of stack 6. The panels 20 are curved thin plates, and spacers 21 are stringers running lengthwise. As a matter of terminology, "spacers" and "stringers" are interchangeable, as is "channel". The preferred cross section for spacers 18 and 36 is channel iron. These two, and panel 20 which passes between them, will all be welded together to make a beam 35. Panel 20 running between the channels adds some flange strength to beam 35. Near the center of the vehicle, three-deep beam 34 uses channels 37, 38, and one more, plus the three curved panels which cross between the spacers. All the other spacers can just be strap iron (no flanges, as shown) and welded to the panels, making a single, solid assembly.

Beams 34 and 35 constitute the special frame means for the vehicle. More details will be given later. The rainbow shape of stack 6 fits smoothly against the concave-curved inner arm 43 of wedge 9's "V". There is a use for these congruent contours.

Figure 4:
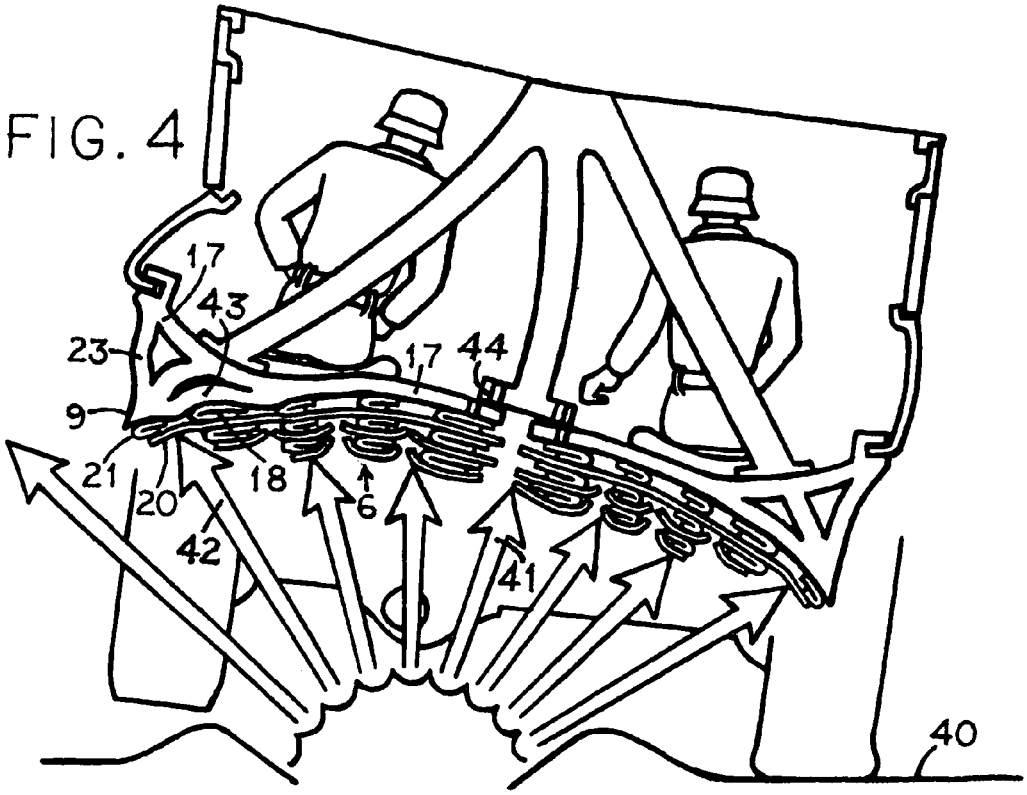
FIG. 4 is the same cross section but exposed to a mine explosion under the vehicle.

FIG. 4 shows the use of stack 6 and wedge 9. A mine buried in roadway 40 has exploded, sending a detonation wave symbolized as large arrows 41, 42 etc. upward toward floor 17 of the vehicle. Some detonations are strong enough to lift the vehicle off the ground, as shown. In any case, panels 20 are slammed upward with great force. Spacers 21 resist but collapse, removing some energy from the detonation wave. That is the main mechanism for protecting the driver: Spacers 21, 18 and the rest buckle, blunting the force of the detonation.

At the same time, wedge 9 takes the impact of detonation gas 42, plus more gas (invisible) passing over numeral 18. Inside arm 43 crushes sideways to the concave outline shown. Wedge 9 probably being an extrusion in aluminum, a softer metal than steel, allows the deformation of the somewhat thick wall 43. This absorbs some energy from the detonation. Also, wedge short arm 23 bulges outward, impelled by gas arrow 42 pushing on spacer 21. This absorbs still more energy. Two things are noted. If wedge 9 did not deform, it might instead be turned into a projectile, probably not a good thing. Second, and more important, inside arm 43's sideways crushing provides substitute protection near the outside edge of floor 17. That is where stack 6 thinned out. In FIG. 3, there's only one panel 20 and spacer 21 at the edge of stack 6. The upper contour of stack 6 is more or less congruent to the lower surface of wedge inside arm 43. Thus, the wedge material takes over where the stack material runs out. This cooperation is one use of wedge 9. A different use follows.

Figure 5:
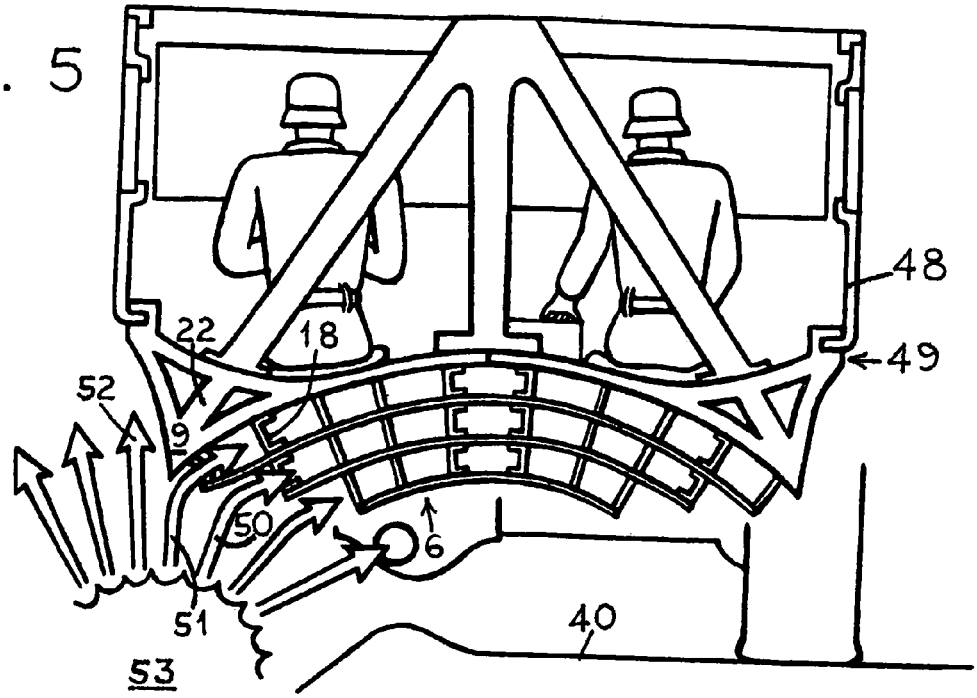
FIG. 5 is the same cross section but exposed to a mine blast in the track of the left front wheel.

In FIG. 5, wedge 9 backed up by brace 22 comes into play during a mine explosion at the edge of the vehicle. This detonation blast is symbolized as large arrows 50-52 etc. radiating out from blast center 53. Blast 53 is in the track of the left front wheel and was caused by a mine buried in roadway 40. It's likely that blast 53 resulted from triggering the mine by compressing a pressure switch (not shown) when the wheel passed over it. In this blast situation wedge 9 is now the first line of defence. Wedge 9 splits the detonation blast into two portions. One portion, symbolized by arrow 52 and its two neighbors at left, passes upward and leftward, expanding into the air outside the vehicle and little impeded.

The other portion of the blast, arrows 50, 51 etc., was deflected by the wedge's inside arm, and veers to the right. There, the blast encounters stack 6. Some blast gas 50, 51 passes through holes 19 (see FIG. 2) in spacers like 18. But this phase can't last long. The reason, seen in FIG. 2, is that spacers 18, 21, etc. have web material around holes 19.

Figure 6:
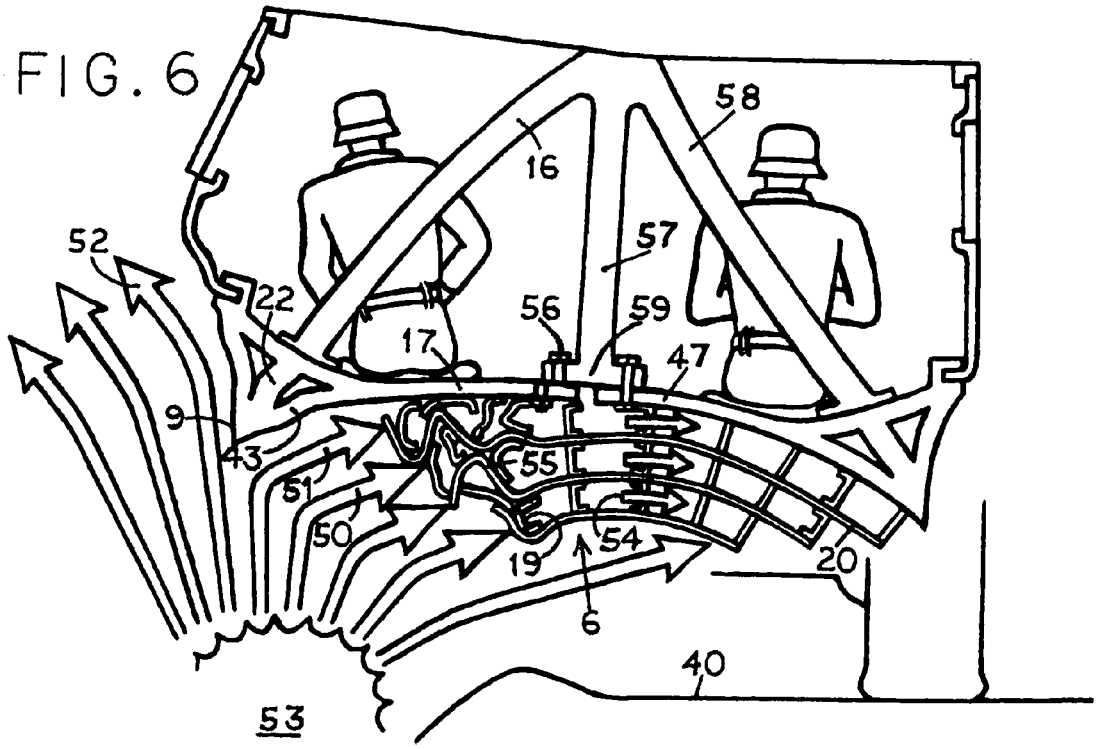
FIG. 6 is the same cross section as FIG. 5 but an instant later.

In FIG. 6, an instant later, this web material has been caught by the blast and hammered into a tangled mass 55 being swept to the right. This is not as favorable as the controlled crushing of spacers 21 in FIG. 4. In FIG. 6, tangled mass 55 is an obstruction to gas flow 50, 51. Probably there will be a transient pressure spike below wedge inside arm 43, lifting that side of the vehicle. If tangled mass 55 is porous enough to leak the pressure spike under floor 17, then the impact of the blast gas initially moving 5,000 feet per second upon wedge arm 43 may lift the left side of the vehicle too.

Under such conditions, wedge 9 will transmit a large upward force to wedge brace 22. Being part of an extrusion in aluminum, a relatively soft metal, brace 22 may squash down a little, as shown. However, wedge 9 endures, retaining its general "V" shape. That's the important difference from FIG. 4. In FIG. 4, wedge 9 crushes sideways to blunt the detonation wave. In FIG. 6, wedge 9 backed up by brace 22 stays more or less intact.

The upward push on brace 22 is passed on to angle brace 16. It's just a sheet steel tube, which bends. The load is transmitted to mirror image brace 58 and central brace 57, then to their attach points at floors 17 and 47. Thus, braces 16, 57 and 58 form a tripod which absorbs some blast gas loads on wedge 9.

Probably the best that can be expected is that the initial flow 54 of blast gas through the holes 19 in spacers will take the edge off the most destructive first wave front of the blast. Then the rest of the blast, pushing up on wedge arm 43, might start to pull floor 17 apart from floor 47, shearing hold-down bolt 56. A remedy for that would be to extend bar 59 forward (not shown) the length of the passenger compartment and use many bolts like 56 to distribute the load and tie floors 17 and 47 together more strongly. The extra bolts would use bolt holes 61, 44 etc (FIG. 7.)

Some general considerations follow. Throughout, the "detonation wave" was for a mine explosion under the vehicle, and the "detonation blast" was from a mine buried substantially in the track of a front wheel. Secondly, because of symmetry, protection for the front row passenger is just the mirror image of protecting the driver. This is seen most clearly in FIG. 3.

That concludes the description of the mine-protection method for the driver. The rest of this text is about how elements of stack 6 make the frame of the vehicle.

Figure 7:
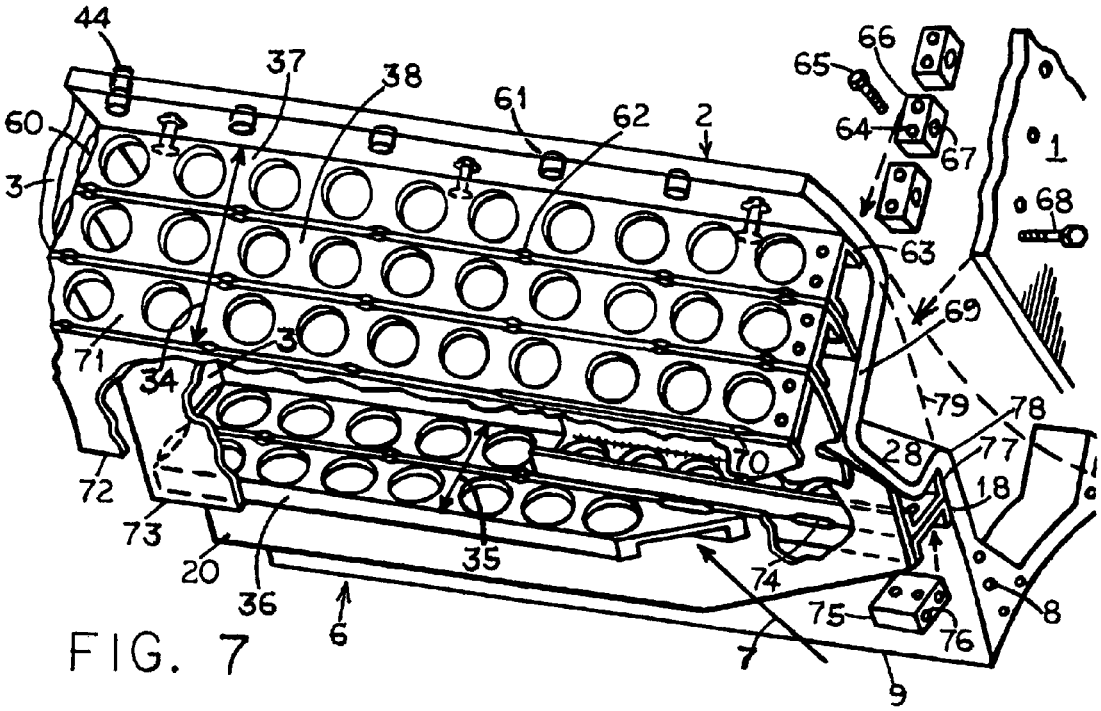
FIG. 7 is a ¾ underside front view of the wedge and stack assembly.

FIG. 7 is a perspective view of driver's platform 2 and stack 6 taken from a direction exactly opposite to that in FIG. 2. In other words, from below and the front, instead of from above and the rear in FIG. 2. In FIG. 7, stack 6 seen partly from below shows panels 20, 73 and 72 spaced apart in an upward direction. The panels are drawn broken open to reveal the structural members within. As in FIG. 3, in FIG. 7 the parts for stack 6 are panels like 20 and spacers like 36. Panels 20 will probably be thin curved steel plates, perhaps 3⁄16 inch thick, and spacers 36 steel channels 3⁄16 inch thick. Panels 20, 73 and 72 alternate with spacers 37, 38 and 71, making a kind of triple-decker sandwich whose parts are joined together by many small welds 62. These "spot" welds may be enough, because flanges 63 and others will keep stack 6 from just folding flat under the detonation wave. The three visible spacers 37, 38 and 71 are vertically aligned, one above the other. The effect is that the three webs of the spacers add up to the web means for a beam 34 of great depth. This beam is realized as a structural member by the bracing effect of panels 20, 73 and 72, which act like the flanges in an I-beam.

Frame member 34 has to connect at each end to some other component. Taking the easy one first, in the rear, channel 37 is welded at 60 to bulkhead 3 (also seen in FIG. 1.) Channels 38 and 71 would be welded to bulkhead 3 too, completing the joint.

At the front, the situation is a little more complicated. Deep beam 34 could just be welded to bulkhead 1. However, platform 2 is such a large part that it shouldn't be ignored as a structural member. But most likely it's an extrusion in aluminum, which can't be welded to steel. It has to bolt to bulkhead 1. Then deep beam 34 can be considered for bolting too, rather than welding. The passenger compartment could be separated from the engine compartment during maintenance. It could be an advantage for replacement or repair of battle damage in the field.

Bolting the right end of beam 34 in FIG. 7 to bulkhead 1 takes three filler blocks like 66 which slip into the right end of spacers 37, 38 and 71. Aligning the holes lets machine screw 65 thread into tapped hole 64 to seat filler block 66. Five more bolts, not shown, would complete the operation. Then the front faces of filler blocks 66 etc. become co-planar with platform 2's machined-flat end face 69. Both surfaces will abut bulkhead 1 for joining. The joining method can be made clearer by looking at platform 2's joint first.

In FIG. 1, joining to bulkhead 1 is by machine screw 10 attaching to wedge 9. A hole 8 was drilled through bulkhead 1 and into wedge 9, then tapped for threads. Machine screw 10 is inserted and tightened, pulling the parts together. In this fashion, an aluminum extrusion wedge 9 can be attached to a steel bulkhead 1. Drilled and tapped hole 8 can also be seen in FIG. 7. Several more holes like hole 8 are shown at the end of wedge 9. They would be needed to make an adequate joint between wedge 9 and bulkhead 1.

Returning to the previous topic, in FIG. 7 filler block 66 can be attached to bulkhead 1 by machine screw 68 tightening into a threaded hole 67 in the filler block front face. Machine screw 68 and filler block 66 then clamp bulkhead 1 between them. Several more screws 68 and threaded holes like hole 67 would complete the joint.

The result of this welding and bolting is understood in FIG. 1 as stack 6 firmly attached to bulkhead 1 at the front and bulkhead 3 at the rear. However, as seen in FIG. 7, strong attaching is only achieved near the center of the vehicle by deep beam 34. At the outside edge of the driver compartment, only wedge 9 so far is attached to bulkhead 1 in FIG. 1, using threaded holes like 8. But this is for machine screws into aluminum, not the strongest joint known. We seek more bracing at the outside edge of the driver compartment.

A candidate for that is spacer 18 of FIGS. 2 and 3. It is fairly near the edge of platform 2, yet close enough to the vertical to have adequate beam strength. Also, in FIG. 7 it avoids being blocked from reaching the front of the assembly by footwell 28. To join spacer 18 to bulkhead 1, a filler block 75 is inserted into the end of channel 18 and bolted into place. Then screws like 68 pass through holes (not shown) in bulkhead 1 and clamp it, using threaded holes 76. Still, only one spacer 18 does not equal three spacers in deep beam 34. We look for yet more bracing.

One restriction is the angled cut-away portion of panel 20 at the front. This is so that sight line 7 (from FIG. 1) which is parallel to the ground can pass without hitting the panel. That preserves the ground clearance suggested in FIG. 1. In FIG. 7, panels 72 and 73 would be cut back too, since they are below panel 20. More bracing is found in spacer 36, which in combination with spacer 18 gives deep beam 35. Spacer 36 can't extend past the angled cut which would be made in panel 73, on which it rests. That angled cut would have the same angle as the cut in the front of panel 20. The cut would be located at the tip of arrow 7. Thus, the angled cut at the right end of spacer 36 observes both the location and an acceptable angle. However, since spacer 36 ends before the end of spacer 18, there is a shortfall in supporting the latter.

The shortfall is made up by doubler beam 77. Beam 77 is welded at 74 (and other places not seen) to spacer 18, doubling its strength. Another filler block, like filler block 75, would fit in the end of beam 77 for bolting to bulkhead 1.

This process of finding pieces of stack 6 to act as frame members might stop right there since what has been found so far will have considerable strength. Too, the presence of footwell 28 and wedge 9 suggest that no more stringers can come through to reach bulkhead 1 without extending below the angle cut at the right end of panel 20. Extending below would hurt ground clearance. Thus, deep beam 34 on one side of platform 2 and deep beam 35 on the other side are considered to constitute special frame means for the vehicle.

In FIG. 3, structural channels 18 and 36 are blacked in and represent deep beam 35 of depth two, compared to depth three for deep beam 34. So, only ⅔ as strong. The difference may be made up by the joint strength of wedge 9. The shading at the tip of wedge 9 symbolizes the bolted joint to bulkhead 1 of FIG. 1 previously seen, but using all the threaded holes like hole 8 in FIG. 7. It's the other increment of frame strength at the outside edge of platform 2. Their sum is expected to approximate the strength of deep beam 34, giving an augmented special frame means.

Another improvement makes the ensemble of stack 6 and wedge 9 more rigid. In FIG. 2, rivet 29 penetrates the left end of brace 22 and continues inward. It will reach channel 18. Rivet 29 will enter channel 18 at an angle, so two angle shims (not shown) should make the interior bolted joint tight. This will attach wedge 9 firmly to channel 18.

Thus, stack 6 components provide a frame for the vehicle, augmented by wedge 9, in addition to protecting the occupants from mines. This attains the secondary goal of the invention. That object all along was to make double use of stack 6 and wedge 9, which otherwise are just dead weight until a mine explosion takes place.

The structural method of the invention uses a fact in the construction of the military "Humvee." From page 88 of "Armored Cav" by Tom Clancy, Berkley Books, N.Y., Copyright 1994, "The primary chassis structure of the Hummer is a pair of massive steel beams that run the entire length of the vehicle." For our purposes, "massive" implies "heavy". It's a window of opportunity for our deep beams 34 and 35 and wedge 9 to take over as replacements, at some penalty in added weight.

Figure 8:
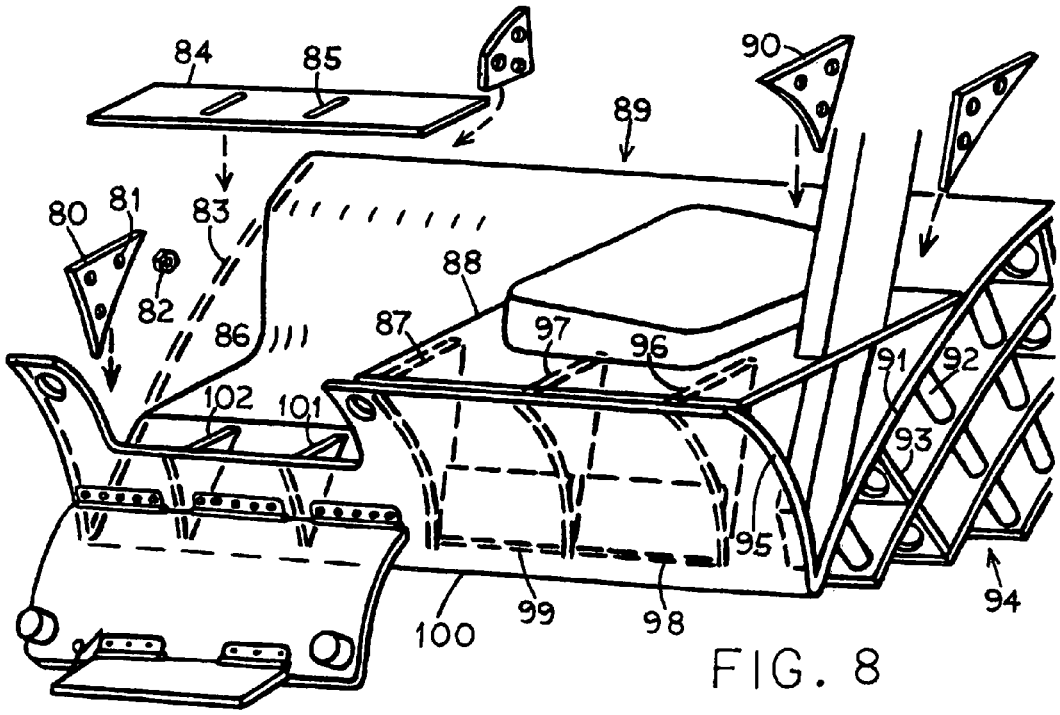
FIG. 8 is a ¾ overhead rear view of an alternate construction for the driver's seating platform.

FIG. 8 is presented as an alternative to FIG. 2. Instead of an aluminum extrusion, platform 89 is welded up from thin steel plate. This solves the weak attachment in FIG. 1 of machine screw 10 threading into aluminum. In FIG. 8, gusset plate 80 will be moved (dashed-line arrow) into the "V" of wedge 100 and welded in place. Then holes 81 can accommodate a machine screw like 10 of FIG. 1 but in combination with nut 82 of FIG. 8. It gives a true bolted joint, which is much stronger.

Fabrication of wedge 100 started by folding a thin metal plate sharply on a bending brake to give the point of the wedge. This formed the characteristic "V" outline of wedge 100's cross section, giving the outside arm 95 and the inside arm 91. It resembles the cross section of wedge 9 of FIG. 2. In FIG. 8, seat support plate 88 after welding in place encloses wedge 100 and strengthens it. Deep draw 86 from the original outline 83 creates a footwell 86 for the driver's right foot. The end result is platform means 89 which resemble platform 2 of FIG. 2.

In FIG. 8, bracing plates 98 and 99 make the point of wedge 100 more rigid against a mine blast like 53 of FIG. 5. In FIG. 8, triangular gussets 87, 96 and 97 further reinforce the point of wedge 100 by bracing the plates 98 and 99.

Wedge 100 can have enough beam strength to act as a frame member. This would save weight. For instance, spacer 93 could be the simple steel strap shown, instead of heavier channel iron 18 of FIGS. 2, 3 and 7. In FIG. 8, beam strength in the shallower, front part of wedge 100 is completed by foot plate 84. It will be moved downward until it covers gussets 101 and 102, then welded to them using access slots like 85. More welding around the perimeter of foot plate 84 will create a fully enclosed, smaller "tube" of triangular cross section. It should have enough strength to be a frame rail. That, plus the taller part of wedge 100 at the right will constitute a beam the length of platform 89. Once gussets 80 and 90 are welded in, and the bolted joints made to bulkheads 1 and 3 of FIG. 1, then the aggregate is deemed an alternative frame member to beam 35.

Now some of the strength of spacers like 93 is unnecessary. They may be replaced by rubber blocks 92, which can be glued in place, saving the cost of much welding. Squashable blocks 92 are still considered structural members, with "openings" represented by the spaces between the blocks.

The three large gussets 87, 96 and 97 stiffen brace plates 98 and 99 which reinforce the point of wedge 100. These five reinforcing parts are the analogue of wedge brace 22 in FIG. 2. In FIG. 8, the back of gusset 87 ends at the back of brace plate 99. Gusset 87 does not extend further under seat support plate 88. The same for the other two large gussets 96 and 97. The reason is to purposely leave the inside arm 91 of wedge 100 partly un-supported. We want inside arm 91 to crush, absorbing energy when the detonation is under the vehicle. In other words, like wedge arm 43 in FIG. 4. Then wedge 100 of FIG. 8 repeats an earlier theme, namely providing the mine protection at the edge of the driver compartment, where the material in stack 94 thins out and ends. This establishes the dual use of wedge 100. It followed closely the model for dual use of wedge 9 illustrated in FIGS. 4 and 5.

In FIG. 1, a second row of seats is indicated by second platform 4 at the rear, where a passenger can sit. There is second stack 5 of construction like stack 6, and the bottom of platform 4 is another wedge. A rear door and door jamb are omitted from the drawing. Second stack 5 can attach to bulkhead 3 like stack 6 attached to bulkhead 1; and bulkhead 1 can attach to engine compartment structural means by bolting (not shown) to sub-frame 11. The new structure associated with the back seat gives extended special frame means for the vehicle.

Bulkheads 1 and 3 can be honeycomb steel sandwich, not solid steel in order to save weight.

The design philosophy for the armoring is that the stack and the wedge must give mine protection without compromising the ground clearance of the vehicle.

The operational plan for the vehicle is that such an armored "Humvee" would be useful in missions where soldiers must be transported over potentially mined terrain but the vehicle doesn't need heavy firepower at the destination. Then several such vehicles would be cheaper to own and operate than a Stryker or an MRAP. This at a penalty to the occupants of having to sit higher than in a regular Humvee.

Housekeeping topics follow.

In FIG. 2, the aluminum directly behind numeral 29 was milled out from the left end of brace 22 to make footwell 27 for the driver's left foot. Between it and deep draw 28 is a small, pyramid-like bump which is also seen as ridge 78 in FIG. 7. Ridge 78 is the necessary rise which makes room for spacer 77 to reach the front of the assembly. But ridge 78 forces the driver, when exiting the vehicle, to lift the right leg over the obstruction instead of just sliding it across. This is actually part of a larger issue: Crew comfort as an aid to performance in the field. Platform 2 in FIG. 1 is installed at a downward angle, placing the driver's feet low, for leg comfort. Platform 89 in FIG. 8 is better, because in addition the floor under the feet is flat.

In FIG. 2, rivets 12 and 13 go through the floor and fasten to the top flanges of the channels, which will end at the rivets. There are quite a few other places in floor 17 where more rivets can go, fastening platform 2 even more tightly to stack 6.

In FIG. 5, tongue-and-groove joint 49 may help keep door 48 closed under a blast (not shown) like blast 53. An enhancement, but not an integral part of the invention.

In FIG. 7, a drawing convention: Panel 20 has been arbitrarily sheared off along its length where it emerges from between stringers 18 and 36 (at the level of double-headed arrow 35.) This is to show the "spot" welds. Panel 20 would normally continue upward like panels 73 and 72.

In FIG. 7, channels 37 and 38 had their flanges 63 etc. pointing away, so the back of the channels showed all the welds 62. In FIG. 2 the channels pointed the other way to show all the holes 19. Continuous-seam weld 70 gives joint strength to stringer 71 without flanges. The scope of the invention is found in the appended claims.

The invention claimed is:

1. A motor vehicle comprising:

an engine compartment located at the front of the vehicle;

a driver compartment located behind the engine compartment, the driver compartment located on one side of the vehicle, and separated from the engine compartment by a bulkhead;

the driver compartment comprising a platform for accommodating the driver;

the bottom of the bulkhead being substantially even with the bottom portion of the platform;

the platform being shaped such that the highest area is located at the rear of the platform for the formation of a driver seat, and the lowest area is located at the front of the platform;

the platform comprising two footwells formed in the front portion of the lower area of the platform;

the footwells comprising a ridge in a line from the back towards the front creating separation of two separate footwells;

the ridge being higher than the floors of the footwells, and the ridge creating a hollow region under it;

the platform installed with a downward facing angle towards the front of the platform, the downward angle allowing the footwells to be in a position lower than the seat;

a beam disposed lengthwise passing under the platform, the beam at least partially filling the hollow region created by the ridge of the platform;

the beam connecting to the bulkhead after passing under the platform, the beam connecting to the bulkhead with substantially none of the beam disposed below the lowest portion of the front of the platform.

2. The motor vehicle of claim 1 comprising:

the platform is comprised of aluminum;

holes are drilled completely through the bulkhead;

holes are drilled into the front of the platform, the holes being tapped and threaded;

the holes drilled through the bulkhead aligning with the threaded and tapped holes drilled into the platform;

machine screws pass through the holes in the bulkhead and threading into the tapped holes of the platform, fastening the platform to the bulkhead.

* * * * *